US006766733B1

(12) United States Patent
Collins

(10) Patent No.: US 6,766,733 B1
(45) Date of Patent: Jul. 27, 2004

(54) INTERCHANGEABLE FLEXIBLE DIE

(75) Inventor: Robert W. Collins, Shawnee, KS (US)

(73) Assignee: Winkler + Dunnebier, AG (DE)

( * ) Notice: Subject to any disclaimer, the term of this patent is extended or adjusted under 35 U.S.C. 154(b) by 0 days.

(21) Appl. No.: 10/458,905

(22) Filed: Jun. 11, 2003

(51) Int. Cl.[7] ..... B44B 5/02

(52) U.S. Cl. ..... 101/28; 101/29; 101/30; 101/31; 101/32; 101/372; 101/373; 101/374

(58) Field of Search ..... 101/3.1–32, 327, 101/372, 373, 374, 401.1, 368

(56) References Cited

U.S. PATENT DOCUMENTS 3,782,166 A * 1/1974 Whistler et al. ..... 72/462
4,204,470 A * 5/1980 Craighead ..... 101/28
4,743,191 A * 5/1988 Chao ..... 425/190
5,399,217 A * 3/1995 Bloom ..... 156/219
5,617,785 A * 4/1997 Lo ..... 101/3.1
6,152,035 A * 11/2000 Scholtz et al. ..... 101/389.1
6,226,882 B1 * 5/2001 Barr ..... 33/528
6,360,658 B1 * 3/2002 Benson ..... 101/109
6,470,585 B2 * 10/2002 Barr ..... 33/528
6,584,893 B2 * 7/2003 Hutchison et al. ..... 101/28
6,694,873 B1 * 2/2004 LaBelle et al. ..... 101/23

* cited by examiner

*Primary Examiner*—Andrew H. Hirshfeld
*Assistant Examiner*—Andrea H. Evans
(74) *Attorney, Agent, or Firm*—Shook, Hardy & Bacon L.L.P.

(57) ABSTRACT

A flexible die is provided which incorporates a base die and a superimposed interchangeable cutting or embossing die. The base die is generally planar and is adapted to securely receiving the superimposed interchangeable die thereon. Protruding upwardly from the outer face of the base die is a raised cutting portion, a raised embossing portion, or both, which raised portion is adapted to cut, form, or emboss the outer periphery of a blank or substrate. The superimposed interchangeable die is generally planar, and includes a raised cutting or embossing portion protruding upwardly from the outer face thereof, which raised portion is adapted to cut, form or emboss a portion of the blank or substrate. At least a portion of the superimposed interchangeable die is adapted to be received onto at least a portion of the base die.

16 Claims, 4 Drawing Sheets

FIG. 4.
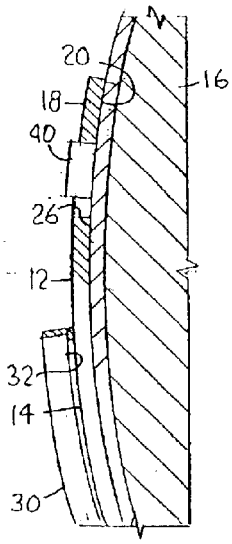
FIG. 3.
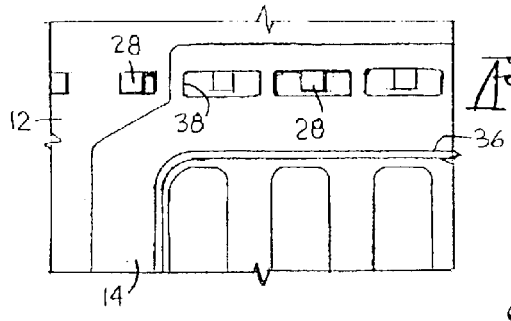
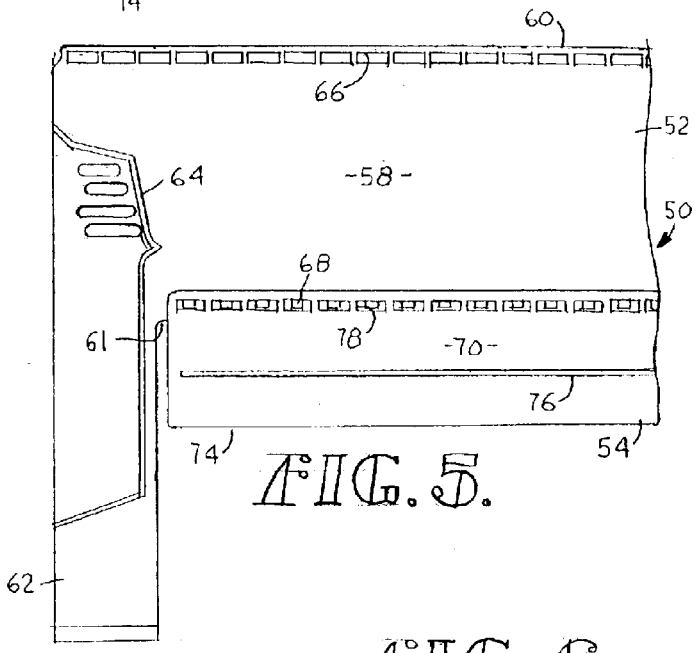
FIG. 5.
FIG. 6.
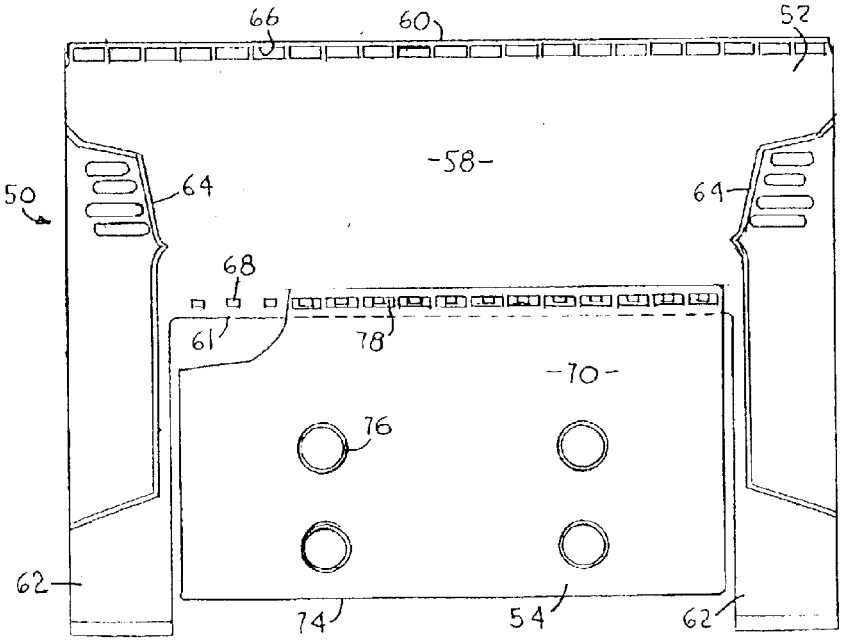

INTERCHANGEABLE FLEXIBLE DIE

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

The present invention relates to a flexible magnetic die for cutting patterns in a sheet or web and for embossing patterns on paper or nonwoven substrates. More particularly, this invention relates to a flexible die for cutting shapes such as blanks or other patterns and for creating embossed patterns, where in the die is capable of receiving a superimposed interchangeable portion thereon to alter the shape cut and/or allow the formation of an opening within the blank for an envelope, cardboard box, cut-out sheet, liner or the like, and/or for embossing patterns on a substrate.

It is well known in the art to cut an envelope or carton blank from a web of paper, and to also provide for a window or other opening in the face or back side of an envelope blank. The window or other opening portion allows for the viewing of an address or other information contained within the envelope or carton. In a typical web-fed envelope folding machine, there is a shape cutting section, which forms the sides of the envelope as the web is passing through the machine. There is then a separate window cutting section, which cuts out the window or other opening, and next the web passes through a separation section which cuts out the seal flap and bottom flap of the envelope. These cutting sections each typically employ cylindrical die holders having a die placed thereon in a desired position to make cuts in the envelope blank as the sheet or web is moved past the die during the envelope forming process. These dies can include a set of apertures, such as rectangular slots, which are adapted to position the die onto registration tabs found on the surface of the die holder. Typically, the die and die holder are formed of metal, and thus the die is magnetically secured to the magnetic die holder. The die further includes a cutting edge of any suitable shape, which can be formed by chemical etching or the like, which edge forms the envelope or carton blanks. In addition to these flexible dies, hard dies are also commonly used in the envelope and carton making processes. These dies can also take the form of corresponding male and female dies. In either of these types of dies, a rectangular shaped cutting edge is also commonly used to form the window or other opening portion of the envelopes. Each different desired size, shape or position of window opening requires a corresponding die which is designed to create a window opening with that specific size, shape or position. Similar dies and processes can be utilized when creating products having embossed portions thereof, such as stationery, napkins, advertisements or the like.

The aforementioned die configurations suffer from a number of drawbacks and deficiencies. First, on envelope folding machines, the cutting process outlined above utilizes three different cutting sections, namely, the side flap cutting section, the separation (seal flap and bottom flap cutting) section, and the window cutting section. Employing these multiple sections increases the costs associated with the machinery used in this process, as well as the manufacturing time and associated costs. In addition, when manufacturing differing sizes or styles of envelopes or cartons, a different die is generally needed for forming each such size or style in order to properly position the desired opening. Using a different die to form a window opening for each different style of envelope or carton, or for each different shape or position of openings, increases manufacturing costs by requiring full removal and replacement of dies during the manufacturing process. Furthermore, the cost, time and effort required to purchase and maintain an inventory of dies for multiple envelope styles is increased.

Accordingly, there remains a need for a die which is easily and quickly interchangeable to reduce the cost of manufacturing envelopes, cartons, cut-out sheets or the like having window or other openings formed therein. In addition, there also remains a need to reduce the number of dies which need to be stored and maintained in inventory. Further, there is a need for a die which can reduce the number of cutting stations employed in the envelope, carton or related forming process. There is also a need for a die system which allows enhanced flexibility and decreased costs in embossing processes. The present invention fills these needs as well as various other needs.

In order to overcome the above-stated problems and limitations, there is provided a die which includes a base die and a superimposed interchangeable cutting or embossing die to allow simultaneous formation of the blank shape cutting and the window cutting or embossing processes. This die system further allows for a variety of window or other openings to be formed in different styles of envelopes or cardboard boxes manufactured from sheets or webs, as well as for a variety of embossed patterns in embossed products, the variations being both with respect to the positioning of the openings or patterns, as well as the shapes and varieties of patterns being formed. In addition, utilizing the superimposed interchangeable dies allows a single die to work with different die holder running cycles.

BRIEF SUMMARY OF THE INVENTION

In general, a shaped blank having a window, cut-out or other opening, or an embossed pattern therein is formed by using a flexible base die which is adapted to receive a superimposed interchangeable die thereon. The base die comprises an essentially planar sheet of material presenting an outer face, an inner face and an outer periphery. A raised portion protrudes essentially upwardly from the outer face and includes a cutting edge which is adapted to cut or form the outer periphery of the blank. This can also or alternatively function as an embossing edge. The inner face of the base die is adapted to be received on the outer surface of the die holder. The base die can be coupled with the die holder by any suitable means, which can include magnetic forces, pins, clamp bars, or the like. A set of apertures comprising at least one aperture is formed in the base die for coupling with corresponding registration tabs on the die holder to thereby position it with respect to the die holder. Typically, the apertures are positioned along one edge of the periphery of the base die. In addition, the base die includes a set of at least one registration tab extending upwardly from the outer face thereof. The superimposed interchangeable die is an essentially planar sheet of material, also presenting an outer face, an inner face and an outer periphery. The interchangeable die has a raised portion which protrudes essentially upwardly from the outer face and includes a cutting edge which is adapted to cut or form a window or other opening portion of the blank, or an embossing edge to create an embossed pattern on the blank. At least a portion of the inner face of the interchangeable die is adapted to be received on the outer face of the base die. A set of at least one aperture is formed in the cutting die, typically along one edge thereof, and is positioned to correspond with and receive the registration tabs of the base die. The apertures in the interchangeable cutting or embossing die and the corresponding registration tabs on the base die are adapted to allow the interchangeable die to be positioned in a number of different locations relative to the base die and to the die holder, thereby allowing selective alteration of the location in which the cutting or embossing edge forms the opening or embossed pattern in the blank. Further, any number of suitable cutting or embossing dies can be coupled with the base die, thereby allowing for the formation of any desired position, shape and/or style of the opening or other cut-out, or of the embossed pattern in the blank. Using this device allows the shape cutting process, and the opening or cut-out forming and/or embossing process to be performed in a single step.

Another embodiment of the present invention provides an essentially u-shaped base die which is adapted to receive a partially superimposed interchangeable die thereon. The u-shaped base die comprises an essentially planar sheet of material presenting an outer face, an inner face, a top edge, a bottom edge, and a pair of legs extending from the bottom edge at opposed sides thereof, forming an essentially u-shaped sheet. A raised portion protrudes essentially upwardly from the outer face and includes a cutting edge which is adapted to cut or form the outer periphery of the blank. This can also or alternatively function as an embossing edge. The inner face of the base die is adapted to be received on the outer surface of the die holder and is coupled therewith by any suitable means, including magnetic fasteners, pins, clamp bars or the like. A set of a least one aperture is formed in the base die for coupling with corresponding registration tabs on the die holder to thereby secure and position it with respect to the die holder. Typically, the apertures are formed along one edge of the base die. In addition, the base die includes a set of at least one registration tab extending from the outer face thereof, and preferably positioned adjacent the bottom edge of the base die, extending between the legs. The partially superimposed interchangeable die is an essentially planar sheet of material, also presenting an outer face, an inner face and an outer periphery. The interchangeable die has a raised portion which protrudes essentially upwardly from the outer face and includes a cutting or embossing edge which is adapted to cut or form the window or other opening portion of the blank, or to form an embossed pattern on the blank. The inner face of the interchangeable die is adapted to be received partially on the outer face of the base die adjacent the registration tabs and between the opposed legs, and partially directly on the outer surface of the die holder. To secure the interchangeable die onto the base die, a set of at least one aperture is formed in the interchangeable die, typically along one edge thereof, and is positioned to correspond with and receive the registration tabs of the base die. The apertures in the interchangeable die and the corresponding registration tabs on the base die are adapted to position the interchangeable die in such a manner that when the interchangeable die is mounted onto the base die, the largest portion of the interchangeable die is mounted directly onto the die holder below the bottom edge and between the legs of the base die. The registration tabs and corresponding apertures further allow the interchangeable die to be positioned in a number of different locations relative to the base die and to the die holder, thereby allowing the location of the opening or embossed pattern in the blank to be selectively altered. Further, any number of suitable cutting or embossing dies can be coupled with the base die, thereby allowing for the formation of any desired position, shape and/or style of the opening or other cut-out, or of the embossed pattern in the blank to be selected.

Further objects, features, and advantages of the present invention over the prior art will become apparent from the detailed description of the drawings which follows, when considered with the attached figures.

BRIEF DESCRIPTION OF THE SEVERAL VIEWS OF THE DRAWING

In the accompanying drawings which form a part of the specification and are to be read in conjunction therewith and in which like reference numerals are employed to indicate like parts in the various views:

FIG. 3 is an enlarged fragmentary plan view depicting the registration tabs of the base die and the corresponding apertures of the interchangeable die when the base die and the interchangeable die are coupled as in FIGS. 1 and 2;

FIG. 4 is an enlarged, fragmentary cross-sectional view of the base die and corresponding interchangeable die mounted on the die holder taken along line 4—4 in FIG. 1;

FIG. 5 is a fragmentary view of an another embodiment of the present invention showing the u-shaped base die with an interchangeable die superimposed thereon;

FIG. 6 is a plan view of the base die of FIG. 5 and an alternative interchangeable die, with a portion of the interchangeable die broken away to illustrate the mounting means of the base die registration tabs and the corresponding interchangeable die apertures;

DETAILED DESCRIPTION OF THE INVENTION

Figure 1:
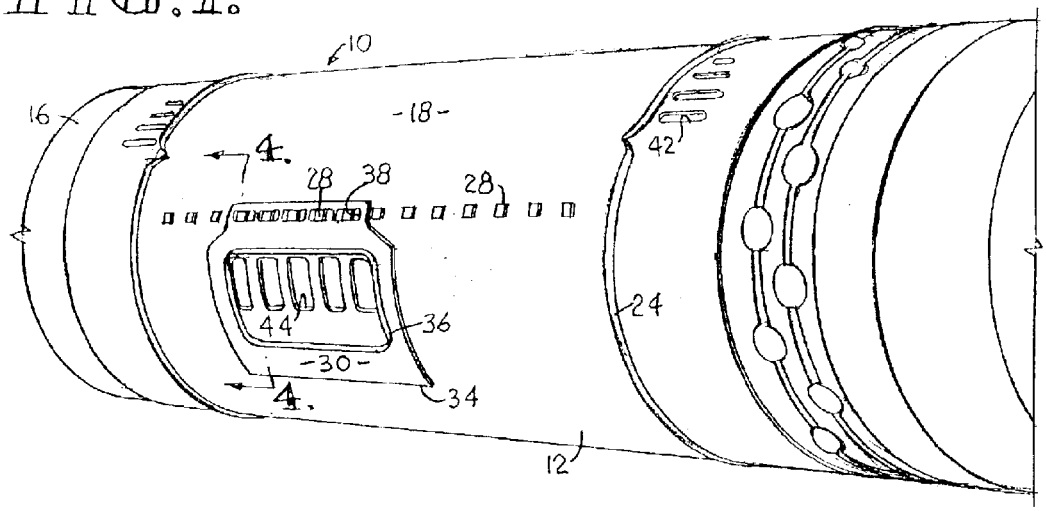
FIG. 1 is a perspective view of a base die and a superimposed interchangeable die according to an embodiment of the present invention, the base die and associated interchangeable die depicted mounted onto a die holder.
Figure 2:
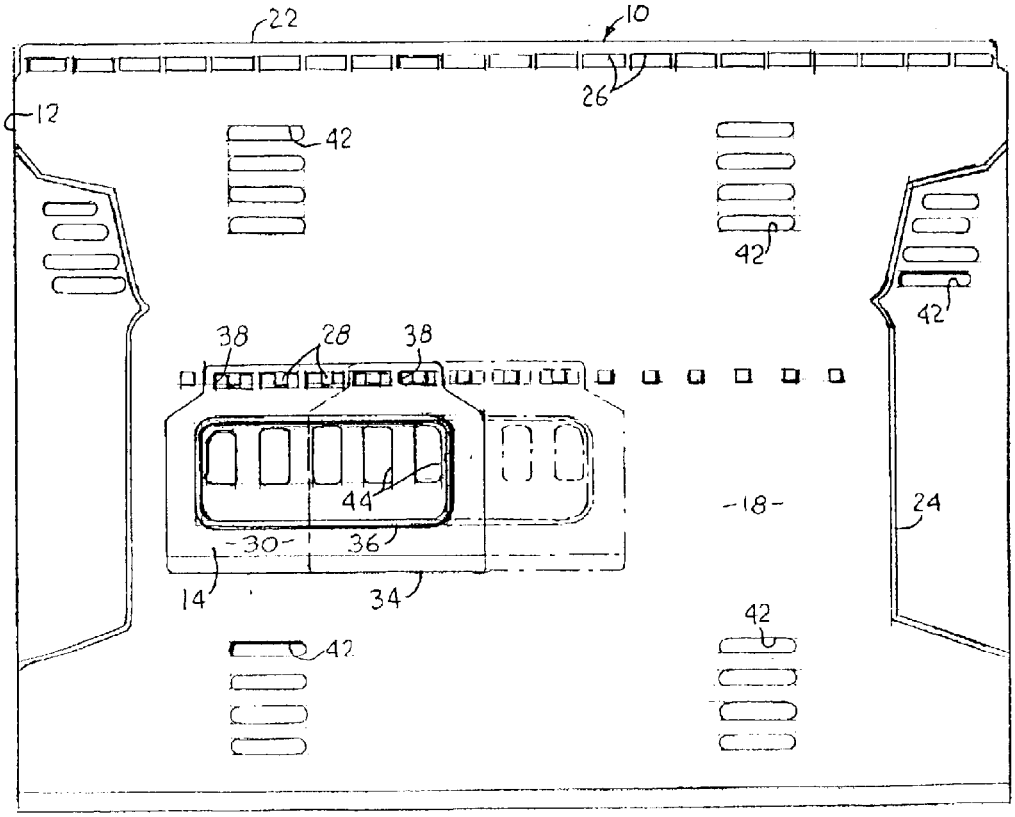
FIG. 2 is an enlarged plan view of the base die and associated interchangeable die shown in FIG. 1, illustrating the relative positioning of the superimposed interchangeable die with respect to the base die.

Referring now to the drawings in detail, and initially to FIGS. 1 and 2, numeral 10 generally designates a flexible die constructed in accordance with one embodiment of the present invention, which die 10 includes a base die 12 and a superimposed interchangeable cutting die 14. Die 10 is generally used in conjunction with a die holder 16, and is adapted to cut an opening in a blank or web used to form an envelope, cardboard box or the like. Specifically, die 10 and die holder 16 each comprise coupling means by which die 10 may be selectively mounted to die holder 16. It will be understood and appreciated that die 10 may be used to form window or other types of openings or cut-outs in various styles of envelopes, cartons, cut-out sheets and the like.

Base die 12 comprises an essentially planar sheet of material presenting an outer face 18, an inner face 20 (shown in FIG. 4), and an outer periphery 22. A raised cutting portion 24 protrudes essentially upwardly from outer face 18 and includes a cutting edge which is adapted to cut or form the outer periphery of the blank. Inner face 20 is adapted to be received on an outer surface of die holder 16. Base die 12 includes a set of at least one aperture 26 positioned along one edge of the base die periphery 22. Base die 12 further includes a set of at least one registration tab 28 extending upwardly from the outer face 18.

Superimposed interchangeable cutting die 14 comprises an essentially planar sheet of material presenting an outer face 30, an inner face 32 (see FIG. 4) and an outer periphery 34. Interchangeable cutting die 14 also comprises a raised cutting portion 36 which protrudes essentially upwardly from outer face 30, cutting portion 36 having a cutting edge which is adapted to cut or form the window or opening portion of the blank. A set of at least one aperture 38 is provided in interchangeable cutting die 14, and in one embodiment can be positioned along an edge thereof. As can be seen in FIGS. 1–4, apertures 38 are adapted to fit around corresponding registration tabs 28 to securely position and superimpose interchangeable cutting die 14 on base die 12, wherein base die outer face 18 is adapted to receive at least a portion of interchangeable die inner face 30. By reference specifically to FIG. 3, it is desirable for apertures 38 to be larger than registration tabs 28, thereby acting primarily as positioning guides. The mounting of interchangeable die 14 onto base die 12 is accomplished by magnetic forces between die 10 and magnetic die holder 16.

Dies 12 and 14 may be formed of any suitable flexible material, and are preferably formed of metal to enable them to be securely coupled with magnetic die holder 16 by magnetic means. However, it is contemplated that dies 12 and 14 can alternatively be formed of rubber, polymeric material or any combination thereof, and other suitable non-magnetic fastening means can be utilized for coupling dies 12 and 14 with die holder 16. It is also contemplated that die 10 be formed of a non-flexible or rigid material. A non-flexible die 10 could be used in conjunction with a die holder adapted to oscillate along an axis to stamp die 10 over the blank to thereby cut the desired opening.

As best seen in FIGS. 1 and 4, die holder 16 is generally cylindrical in shape and is adapted to rotate about its longitudinal axis to intermittently place die 10 in a position to cut a blank and an opening in an envelope web or sheet passing adjacent to it. In this embodiment, die holder 16 includes a series of positioning lugs 40, which are protrusions extending from the outer surface of die holder 16. These lugs 40 operate to couple with base die apertures 26 to releasably mount base die 12 to die holder 16. As base die 12 is preferably fabricated from metal, base die inner face 20 is securely retained against the outer surface of die holder 16 by magnetic forces.

As best seen in FIG. 2, a plurality of apertures 42 are formed in base die 12 both inside and outside the periphery of base die raised cutting portion 24. In addition, a plurality of apertures 44 are formed in interchangeable die 14 within the periphery of raised cutting portion 36. Apertures 42, 44 are positioned to allow a vacuum system (not shown) to aid in the removal of cut-out portions from the shaped blank during the blank and cut-out forming process. More specifically, the vacuum system is adapted to create a pressure differential adjacent to the waste portions formed around and within the shaped blank to retain the waste against die holder 16, pulling the waste portions of the shaped blank away from the blank as the desired product is formed.

In use, base die 12 is first positioned on die holder 16 by corresponding positioning lugs 40 and base die apertures 26. Superimposed interchangeable die 14 is next positioned over base die 12 by corresponding interchangeable die apertures 38 and base die registration tabs 28, and is securely retained thereon by magnetic forces. In this manner, at least a portion of interchangeable die 14 is superimposed over a portion of base die 12. As can best be seen in FIG. 2, interchangeable die 14 can be positioned at a number of different locations, ultimately depending upon the desired location of the cut-out or other opening to be formed in the blank. The solid lines in FIG. 2 depict placement of the interchangeable die 14 at a first position, while the phantom lines depict interchangeable die 14 at a second possible position. As is apparent, the use of superimposed interchangeable die 14 in combination with base die 12 allows a great deal of flexibility in the selected positioning of the window, cut-out or other opening.

In view of the magnetic forces of die holder 16 acting on base die 12 and on superimposed interchangeable die 14, it is desirable for interchangeable die 14 of this embodiment to be of a thickness less than that of base die 12, enabling the magnetic forces of die holder 16 to more firmly secure interchangeable die 14 to base die 12, and ultimately to die holder 16.

In one embodiment, as the blank enters the shaping and opening cutting portion of the manufacturing process, die holder 16 with die 10 secured thereon rotates about its longitudinal axis. Raised cutting portions 24, 36 pierce the blank, and the cut-out waste portions surrounding and within the shaped blank are drawn to top surface of die 10 and held thereon by the pressure differential created by the vacuum system. It is understood that the positioning and shape of raised cutting portions 24 and 36 are selected as is desired for forming each specific end product, which can include items such as, but not limited to, envelopes, cartons, cut-outs, liners, or the like. After the shaped blank and opening portions have been formed, the envelope blank proceeds through the manufacturing process and die holder 16 continues to rotate about its longitudinal axis, whereby the vacuum system is momentarily deactivated to release the cut-out portions from die 10. Once the cut-out portions are released, a suction tube (not shown) is used to transport the cut-out portions to a location away from the die holder 16 so they do not interfere with the continuing cutting process, and the vacuum system is then reactivated. The process is repeated as the die holder 16 continues to rotate and the next blank is moved adjacent to die 10.

The location of the opening portion formed in the blank may be altered by changing the position of interchangeable cutting die 14 relative to base die 12, as by selecting the specific registrations tabs 28 on which interchangeable die apertures 38 are positioned. Of course, different cutting dies can be interchanged with interchangeable die 14 depicted in the drawings, to further alter the position or shape of the opening formed in the blank. Thus, any number of suitable cutting dies can be superimposed on base die 12 to create the desired opening.

Turning now to FIGS. 5 and 6, numeral 50 generally designates a flexible die constructed in accordance with a second embodiment of the present invention. Die 50 includes an essentially u-shaped base die 52 and an interchangeable die 54 adapted to be received thereon. As with die 10, die 50 is generally used in conjunction with a die holder, and is adapted to cut a opening in a blank or web used to form an envelope, cardboard box or the like, and can be modified to perform embossing functions as described in detail above. Specifically, die 50 includes means for selectively coupling with a die holder. As discussed above, the die holder can comprise a magnetic cylinder, and the coupling means can be magnetic fasteners.

Base die 52 comprises an essentially planar u-shaped sheet of material presenting an outer face 58, an inner face (not shown), a top edge 60, a bottom edge 61, and a pair of opposed legs 62 extending from the bottom edge 61 at opposed sides thereof, forming an essentially u-shaped sheet. A raised cutting portion 64 protrudes upwardly from the outer face 58 and includes a cutting edge which is adapted to cut or form the outer periphery of the blank. At least a portion of the inner face of base die 52 is adapted to be received on the outer surface of the die holder. Base die 52 includes a set of at least one aperture 66 positioned along one edge of the base die periphery, and in one embodiment, apertures 66 are positioned along top edge 60. Base die 52 further includes a set of at least one registration tab 68 extending upwardly from outer face 58. These registration tabs 68 can extend between legs 62 adjacent bottom edge 61.

The superimposed interchangeable die 54 is an essentially planar sheet of material, also presenting an outer face 70, an inner face (not shown) and an outer periphery 74. Interchangeable die 54 has a raised cutting portion 76 which protrudes upwardly from the outer face 70 and includes a cutting edge which is adapted to cut or form the window, cut-out or other opening portion of the blank. A set of at least one aperture 78 is provided in interchangeable die 54, and in one embodiment can be positioned along a top edge thereof. As can be seen in FIGS. 5 and 6, apertures 78 are positioned to correspond with and are adapted to fit around registration tabs 68 to securely orient interchangeable die 54 on base die 52, wherein a portion of base die outer face 58 is adapted to receive a portion of interchangeable die inner face. It is desirable for apertures 78 to be larger than registration tabs 68, thereby acting primarily as positioning guides. The mounting of interchangeable die 54 onto base die 52 is accomplished by magnetic forces from the magnetic die holder.

When mounted on base die 52 in this manner, interchangeable die 54 is partially superimposed on top of base die 52 adjacent bottom edge 61, and extends from bottom edge 61 between legs 62. As can be seen, only that portion of interchangeable die 54 adjacent apertures 78 is superimposed on base die 52. Although the opposed edges of interchangeable dies 54 depicted in FIGS. 5 and 6 extend almost to the inner edges of legs 62, it is understood that die 54 can, but need not, span this entire distance, or it can extend across a smaller segment of this distance. In this manner, registration tabs 68 and corresponding apertures 78 can allow the interchangeable die 54 to be positioned in a number of different locations relative to base die 52 and to the die holder, thereby altering the location of the opening ultimately formed in the shaped blank. Further, any number of suitable interchangeable cutting dies or, alternatively, embossing dies, can be employed, thereby allowing for variation in the position, shape and/or style of the opening or other cut-out, or of the embossed pattern formed in the blank.

In use, base die 52 is first mounted on the die holder, typically by engaging base die apertures 66 with corresponding lugs on the die holder. In a preferred embodiment, magnetic fasteners are adapted to retain the inner face of base die 52 securely against the outer surface of the die holder. Interchangeable die 54 is next positioned over base die 52 by corresponding interchangeable die apertures 78 and base die registration tabs 68. In this manner, a portion of interchangeable die 54 is superimposed over a portion of base die 52, typically adjacent apertures 78 and registration tabs 68, respectively. Another portion of interchangeable die 54 is positioned directly onto the die holder, with the inner face of interchangeable die 54 being received on the outer surface of the die holder. Interchangeable die 54 is securely retained on base die 52 and on the die holder by means of the magnetic forces of the magnetic die holder. As is apparent, the use of superimposed interchangeable die 54 in combination with base die 52 allows a great deal of flexibility in the positioning, style, and shape of the window, cut-out or other opening.

Unlike the embodiment depicted in FIGS. 1–4, the majority of the inner face of interchangeable die 54 lies directly against the magnetic die holder. Thus, it is not necessary that the thickness of interchangeable die 54 be reduced with respect to the thickness of base die 52 in order for the magnetic forces from the die holder to securely retain interchangeable die 54 thereon. The process of utilizing die 50 to cut shaped blanks and cut-out or other opening portions is essentially the same as described above for die 10.

Figure 7:
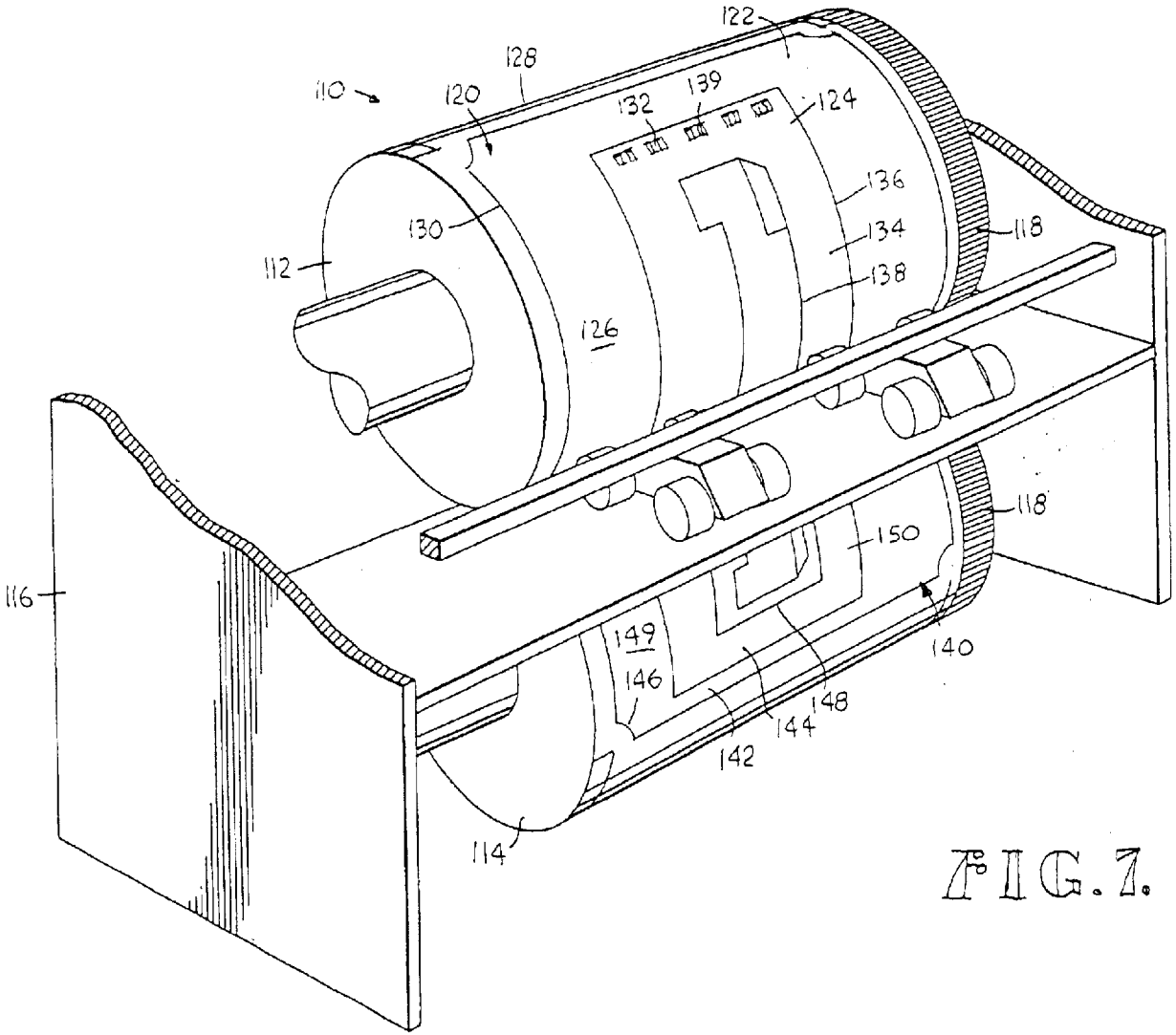
FIG. 7 is a perspective view of an embodiment of the present invention showing use of the base die and the superimposed interchangeable die mounted on die holders for use in connection with carton manufacturing equipment.

According to one embodiment of the present invention, a base die and a superimposed interchangeable cutting die can be used in connection with a device for manufacturing cartons from a folded carton blank. Referring now to FIG. 7, numeral 110 generally designates a folding carton blank manufacturing device incorporating flexible dies in accordance with the present invention. Device 110 generally comprises a top cylinder 112 and a bottom cylinder 114 mounted to a main housing 116. Top cylinder 112 and bottom cylinder 114 are disposed in a manner that allows them to rotate with respect to each other. According to one embodiment, cylinder 112 and bottom cylinder 114 include a plurality of splines 118 radially disposed about one circumferential edge of each cylinder, whereby the splines 118 of one cylinder engage the splines 118 of the other cylinder. In this manner, when the first cylinder is rotated, the engaged splines cause the second cylinder to rotate as well. It should be understood that the manner by which top cylinder 112 and bottom cylinder 114 rotate can be any suitable method for rotation.

Male die 120 is coupled to top cylinder 112, and in accordance with the present invention, includes male base die 122 and male interchangeable die 124. As with the base die 12 and interchangeable cutting die 14 described above and illustrated in FIGS. 1–6, male base die 122 comprises an essentially planar sheet of material presenting an outer face 126, an inner face (not shown) and an outer periphery 128. A raised cutting portion 130 protrudes upwardly from outer face 126 and includes a cutting edge which is adapted to cut or form the outer periphery of the carton blank. Inner face is adapted to be received on an outer surface of top cylinder 112. Male base die 122 includes means for positioning and securing it to top cylinder 112, which means can comprise a set of at least one aperture (not shown) positioned along one edge of male base die outer periphery 128 and corresponding positioning lugs on top cylinder 112. Male base die 122 further includes a set of at least one registration tab 132 extending upwardly from outer face 126.

Male interchangeable die 124 comprises an essentially planar sheet of material presenting an outer face 134, an inner face (not shown) and an outer periphery 136. Male interchangeable die 124 also comprises a raised cutting portion 138 which protrudes upwardly from outer face 134, cutting portion 138 having a cutting edge which is adapted to cut or form the window, cut-out or other opening portion of the blank. A set of apertures 139 are provided in male interchangeable die 124, and in one embodiment can be positioned along an edge thereof. As can be seen in FIG. 7, apertures 139 are adapted to fit around corresponding registration tabs 132 to securely position male interchangeable die 124 on male base die 122, wherein male base die outer face 126 is adapted to receive the male interchangeable die inner face. As described above, the mounting of male interchangeable die 124 onto male base die 122 can be secured by magnetic forces between dies 122, 124 and magnetic top cylinder 112.

As further seen in FIG. 7, female die 140 is coupled to bottom cylinder 114, and comprises female base die 142 and female interchangeable die 144. Female base die 142 comprises an essentially planar sheet of material presenting an outer face 149 and an inner face (not shown). Female base die 142 also comprises a raised portion 146 which extends from outer face 149 and includes a medial channel therewithin, which medial channel is adapted to receive raised portion 130 when male die 120 and female die 140 converge to cut the carton sheet or web. Similarly, female interchangeable die 144 comprises an essentially planar sheet of material presenting an outer face 150 and an inner face (not shown). Female interchangeable die 144 also comprises a raised portion 148 which extends from outer face 150 and includes a medial channel therewithin, which medial channel is adapted to receive raised portion 138 when male die 120 and female die 140 converge to cut the carton sheet or web. Although not depicted in the drawings, female interchangeable die 144 can be positioned and secured to female base die 142 as is described above in connection with male interchangeable die 124 and male base die 122, namely apertures adapted to receive corresponding registration tabs therein.

Typically, top cylinder 112 and bottom cylinder 114 are formed of a magnetic material, and accordingly male die 120 and female die 140 are also formed of metal so that the dies are magnetically coupled with the cylinders. It will be understood and appreciated that any suitable mechanical fastener, adhesive or the like may be used to couple the dies to the cylinders. Further, male die 120 and corresponding female die 140 may be formed of any suitable flexible magnetic material. However, it is contemplated that dies 120 and 140 can alternatively be formed of rubber, polymeric material or any combination thereof. It is also contemplated that dies 120, 140 can be formed of a non-flexible or rigid material. Such non-flexible dies could be used in conjunction with die holders adapted to oscillate along an axis to stamp the dies over the carton blank to thereby cut the desired shape and openings therein.

Male die 120 and female die 140 are generally used to cut a sheet into a folded carton blank. In particular, raised peripheral portion 130 of male base die 122 is arranged in the shape of the folding carton blank, while raised portion 138 of male interchangeable die 124 will define the window, cut-out or other opening to be formed in the carton blank. Further, raised peripheral portion 146 of female base die 142 is arranged in a shape which corresponds to the shape of raised portion 130, and raised portion 148 of female interchangeable die 144 is shaped and adapted to correspond with raised portion 138. As will be discussed below, when the sheet or web passes between male die 120 and female die 140, the desired pattern is cut into the carton blank as the raised portions 130, 138 of male dies 122, 124 are received in the corresponding medial channels of raised portions 146, 148 of female dies 142, 144.

In operation, a web or sheet is first fed between top cylinder 112 and bottom cylinder 114, and male die 120 and female die 140 cut the sheet or paper material into a folding carton blank. Specifically, as bottom cylinder 114 is rotated, the splines 118 on top cylinder 112 and bottom cylinder 114 engage each other, and top cylinder 112 is thereby rotated in the opposite direction. The rotation of top cylinder 112 and bottom cylinder 114 operates to feed the sheet between the cylinders, and as male dies 120 and female dies 140 come into contact with each other, the folding carton blank is cut by the action of raised portions 130, 138 and the corresponding medial channels of dies 142, 144, thereby forming the desired folding carton blank and waste product. As stated above, the waste material may surround the blank, or may also be located within the blank if a window or other opening portion is to be formed in the pattern. Subsequent to this blank and window or opening forming stage, the carton blank continues through the carton making process, as will be understood by those skilled in the art. Further, dies 120 and 140 can be modified to accomplish embossing functions in addition to, or alternatively with, cutting functions, as has been described herein in detail in connection with other embodiments of this invention.

Figure 8:
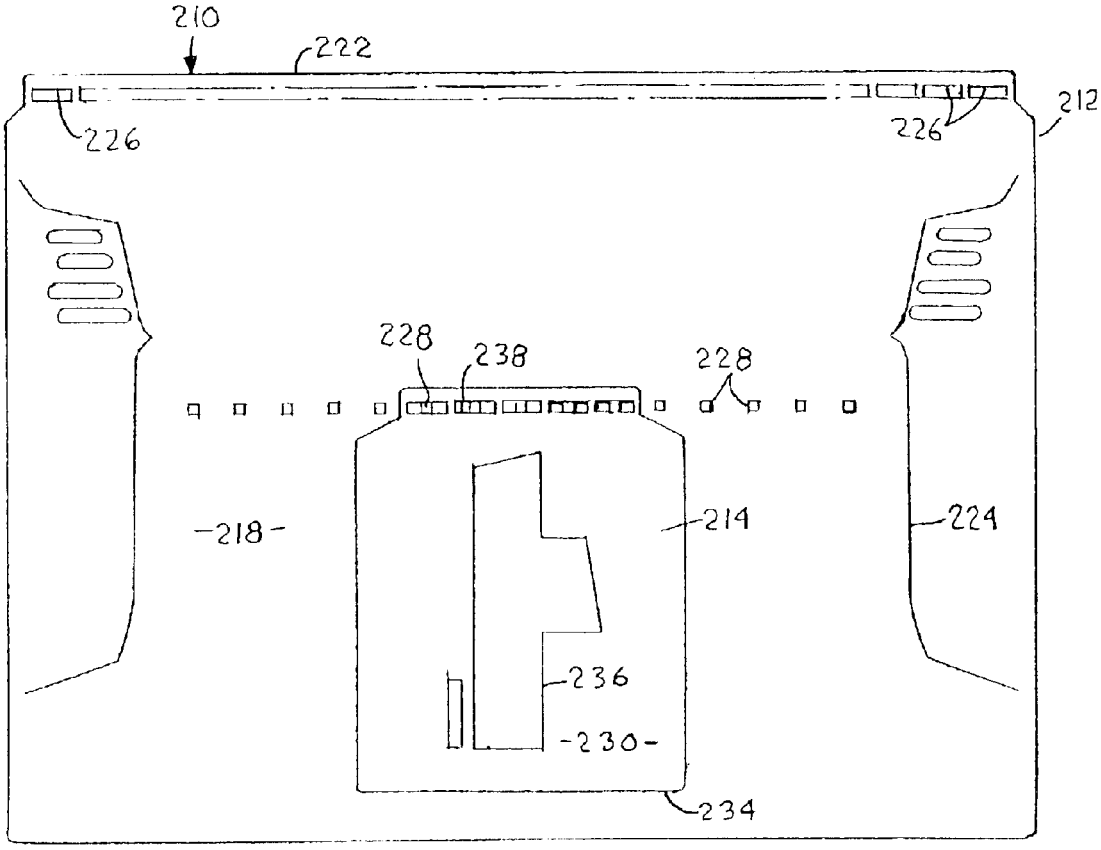
FIG. 8 is a plan view of the base die and associated interchangeable embossing die according to an embodiment of the present invention, illustrating the relative positioning of the embossing die superimposed onto the base die.

In addition to the envelope and carton forming process described above, dies 10, 50 of this invention are also useful in embossing processes. By utilizing a modification of the above described interchangeable dies and die cutting processes, namely, by modifying at least a part of the raised cutting portions of the dies to merely emboss and not actually pierce the blank or web, it is possible to create embossing patterns on a substrate or paper, such as napkins having an embossed border and/or embossed logo positioned thereon. Turning now to FIG. 8, die 210 includes a base die 212 and an interchangeable embossing die 214. Die 210 is used similarly to die 10, typically by being used in conjunction with a die holder, and is adapted to create an embossing pattern on a blank, web or substrate used to form napkins or the like. Specifically, base die 212 comprises an essentially planar sheet of material presenting an outer face 218, an inner face (not shown), and an outer periphery 222. A raised cutting portion 224 protrudes upwardly from outer face 218, and includes a cutting edge which is adapted to cut or form the outer periphery of the blank. The inner face is adapted to be received on an outer surface of the die holder. Base die 212 includes a set of at least one aperture 226 positioned along one edge of the base die periphery 222, and further includes a set of a least one registration tab 228 extending upwardly from the outer face 218. In addition, base die 212 can include a raised embossing portion for creating an embossing pattern such as a border of the like, in place of, or in addition to, raised cutting portion 224.

Embossing die 214 comprises an essentially planar sheet of material presenting an outer face 230, an inner face (not shown) and an outer periphery 234. Embossing die 214 also comprises a raised embossing portion 236 which protrudes upwardly from outer face 230, embossing portion 236 having an embossing edge which is adapted to emboss a desired pattern on the blank or substrate. A set of at least one aperture 238 is provided in embossing die 214, and in one embodiment can be positioned along an edge thereof. Apertures 238 are adapted to fit around corresponding registration tabs 228 to securely position embossing die 214 on base die 212, wherein the base die outer face 218 is adapted to receive the embossing die inner face. As is apparent, it is desirable for apertures 238 to be larger than registration tabs 228, thereby acting primarily as positioned guides. In one embodiment, the mounting of embossing die 214 onto base die 212 is secured by magnetic forces between die 210 and the magnetic die holder.

Dies 212 and 214 may be formed of any suitable flexible material, and are preferably formed of metal to enable them to be securely coupled with a magnetic die holder by magnetic means. However, it is contemplated that dies 212 and 214 can alternatively be formed of rubber, polymeric material or any combination thereof, and other suitable means can be utilized for coupling dies 212 and 214 with the die holder. It is also contemplated that die 210 be formed of a non-flexible or rigid material. A non-flexible die 210 could be used in conjunction with a die holder adapted to oscillate along an axis to stamp die 210 over the blank to thereby cut the desired blank shaped and associated embossing pattern.

Embossing die 210 is used in the same manner as dies 10 and 50, described in detail above. Specifically, raised cutting or embossing portion 224 of base die 212 can be used to cut the desired shape of the substrate, as well as to form an embossed pattern around the relative periphery of the substrate. Raised embossing portion 236 of embossing die 214 is used to form embossed patterns in the center or interior portion of the substrate, such as a napkin or the like. In this manner, a single base die 212 can be utilized to create a border for napkins or the like, while an interchangeable embossing die 214 could be selectively interchanged to create any of a number of desired logos on the substrates. Utilizing base die 212 with interchangeable embossing dies 214 to create napkins or the like having embossed borders and any of a number of possible embossed logos or designs therein greatly reduces manufacturing costs as well as costs associated with purchasing and storing numerous embossing dies.

From the foregoing it will be seen that this invention is one well adapted to attain all ends and objects herein above set forth together with the other advantages which are obvious and which are inherent to the structure. It will be understood that certain features and subcombinations are of utility and may be employed without reference to other features and subcombinations. This is contemplated by and is within the scope of the invention. Further, since many possible embodiments may be made of the invention without departing from the scope thereof, it is to be understood that all matter herein set forth or shown in the accompanying drawings is to be interpreted as illustrative of applications of the principles of this invention, and not in a limiting sense.

What is claimed is:

1. A die adapted to be coupled with a die holder, the die comprising:

a base die comprising a flexible magnetic die, and further comprising an essentially planar sheet of material presenting an outer face, an inner face, and an outer periphery, and including a raised portion protruding essentially upwardly from the outer face thereof, wherein the raised cutting portion includes a cutting edge which is adapted to cut the outer periphery of a blank or substrate;

a superimposed interchangeable die comprising a flexible magnetic die, and further comprising an essentially planar sheet of material presenting an outer face, an inner face, and an outer periphery, and including a raised portion protruding essentially upwardly from the outer face thereof; and means for selectively coupling the magnetic base die with the superimposed magnetic interchangeable die, wherein the coupling means comprises magnetic coupling.

2. The die as set forth in claim 1, wherein the base die is essentially u-shaped.

3. The die as set forth in claim 1, wherein the base die raised portion includes an embossing edge which is adapted to form embossed patterns on a blank or substrate.

4. The die as set forth in claim 1, wherein the interchangeable die raised portion includes a cutting edge which is adapted to cut or form an opening within a blank or substrate.

5. The die as set forth in claim 1, wherein the interchangeable die raised portion includes an embossing edge which is adapted to form embossed patterns on a blank or substrate.

6. The die as set forth in claim 1, wherein the interchangeable die raised portion includes a cutting edge which is adapted to cut or form an opening within a blank or substrate, and an embossing edge which is adapted to form embossed patterns on the blank or substrate.

7. The die as set forth in claim 1, wherein the outer face of the base die is adapted to receive and securely position at least a portion of the superimposed interchangeable die thereon.

8. The die as set forth in claim 7, wherein the base die includes a set of registration tabs comprising at least one registration tab, and the superimposed interchangeable die includes therein a set of corresponding apertures comprising at least one aperture, whereby each aperture is adapted to selectively receive a registration tab therethrough.

9. The die as forth in claim 7, wherein the interchangeable die is adapted to be received onto the base die in more than one position.

10. A die adapted to be coupled with a die holder, the die comprising:

a base die comprising a flexible magnetic die, and further comprising an essentially planar sheet of material presenting an outer face, an inner face, and an outer periphery, and including a raised portion protruding essentially upwardly from the outer face thereof, wherein the raised portion includes a cutting edge which is adapted to cut the outer periphery of a blank or substrate;

a superimposed interchangeable die comprising a flexible magnetic die, and further comprising an essentially planar sheet of material presenting an outer face, an inner face, and an outer periphery, and including a raised portion protruding essentially upwardly from the outer face thereof; and means for selectively coupling the magnetic base die with the magnetic interchangeable die, wherein the coupling means comprises magnetic coupling, and wherein the outer face of the base die is adapted to receive and securely position at least a portion of the interchangeable die thereon, and the base die includes a set of registration tabs comprising at least one registration tab and extending from the outer face thereof, and the interchangeable die includes therein a set of corresponding apertures comprising at least one aperture, whereby each aperture is adapted to selectively receive a corresponding registration tab therethrough.

11. The die as set forth in claim 10, wherein the interchangeable die is adapted to be received onto the base die in more than one position.

12. The die as set forth in claim 10, wherein the base die is essentially u-shaped.

13. The die as set forth in claim 10, wherein the base die raised portion includes an embossing edge which is adapted to form embossed patterns on a blank or substrate.

14. The die as set forth in claim 10, wherein the interchangeable die raised portion includes a cutting edge which is adapted to cut or form an opening within a blank or substrate.

15. The die as set forth in claim 11, wherein the interchangeable die raised portion includes an embossing edge which is adapted to form embossed patterns on a blank or substrate.

16. The die as set forth in claim 11, wherein the interchangeable die raised portion includes a cutting edge which is adapted to cut or form an opening within a blank or substrate, and an bossing edge which is adapted to form embossed patterns on a blank or subtrate.

* * * * *